US007635320B2

(12) United States Patent
Horvath

(10) Patent No.: US 7,635,320 B2
(45) Date of Patent: Dec. 22, 2009

(54) EXERCISE DEVICE

(76) Inventor: Juliu Horvath, 2457 Collins Ave., Miami Beach, FL (US) 33140-4722

( * ) Notice: Subject to any disclaimer, the term of this patent is extended or adjusted under 35 U.S.C. 154(b) by 1046 days.

(21) Appl. No.: 10/900,750

(22) Filed: Jul. 28, 2004

(65) Prior Publication Data

US 2005/0245357 A1 Nov. 3, 2005

Related U.S. Application Data

(60) Provisional application No. 60/566,852, filed on Apr. 30, 2004.

(51) Int. Cl.
*A63B 22/00* (2006.01)

(52) U.S. Cl. ..... 482/51; 74/551.3

(58) Field of Classification Search ..... 482/5, 482/44, 45, 46, 54, 57, 571; 74/55.6, 551.1, 74/551.3, 551.4, 551.8, 551.81
See application file for complete search history.

(56) References Cited

U.S. PATENT DOCUMENTS 3,268,194 A * 8/1966 Nielsen ..... 248/188.2
4,023,436 A * 5/1977 Dodge ..... 74/551.3
4,621,805 A * 11/1986 Chen ..... 482/57
4,836,530 A * 6/1989 Stanley, Jr. ..... 482/27
5,232,422 A * 8/1993 Bishop, Jr. ..... 482/57
5,241,881 A * 9/1993 Chen ..... 74/551.2
5,330,402 A * 7/1994 Johnson ..... 482/62
5,685,237 A * 11/1997 Lehrman ..... 108/118
6,206,395 B1 * 3/2001 Young ..... 280/278

* cited by examiner

*Primary Examiner*—Loan H Thanh
*Assistant Examiner*—Tam Nguyen
(74) *Attorney, Agent, or Firm*—Ostrolenk Faber LLP

(57) ABSTRACT

An exercise apparatus with two legs attached to opposite lateral sides of a front part of a base so as to be swingable away from and toward the base in a horizontal plane, the legs being adjustable relative to the base, is provided. A head member is mounted on an upper end of a telescoping shaft of a support column pivotally mounted to the front part of the base and a pair of arms is mounted on opposite sides of the head member so as to be pivotable about a horizontal axis, and about an axis perpendicular to the horizontal axis, and securable at various positions so as to change an angle defined by the arms. A separate exercise unit is mounted to a free end of each arm so that the exercise unit can be rotated about a longitudinal axis of the arm and secured in desired positions.

14 Claims, 7 Drawing Sheets

FIG.3
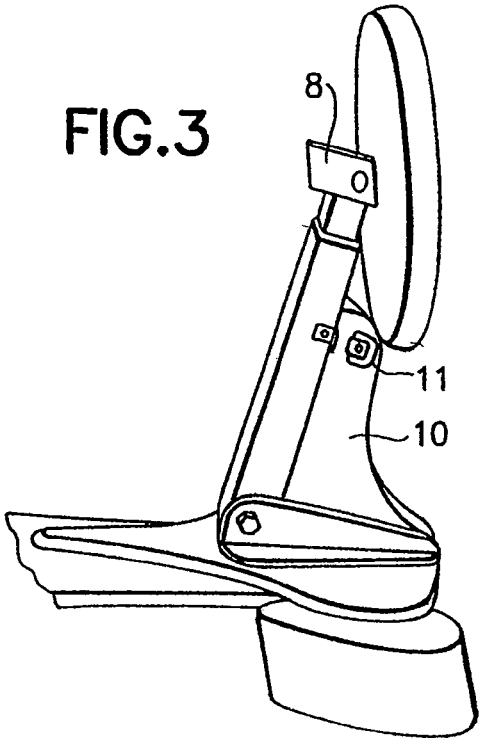
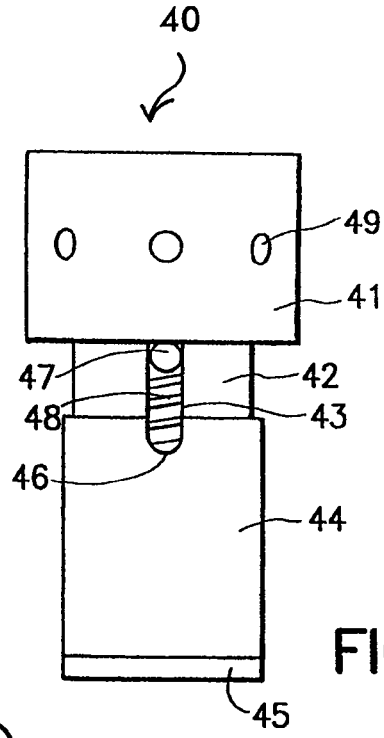
FIG.10
FIG.11
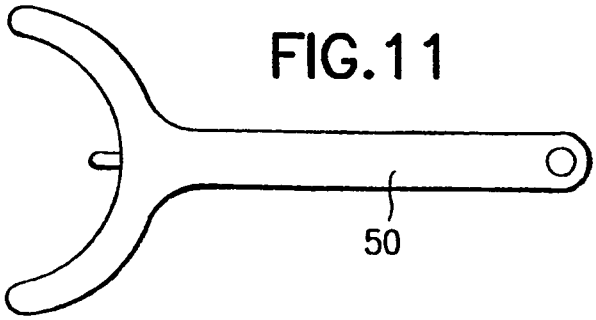

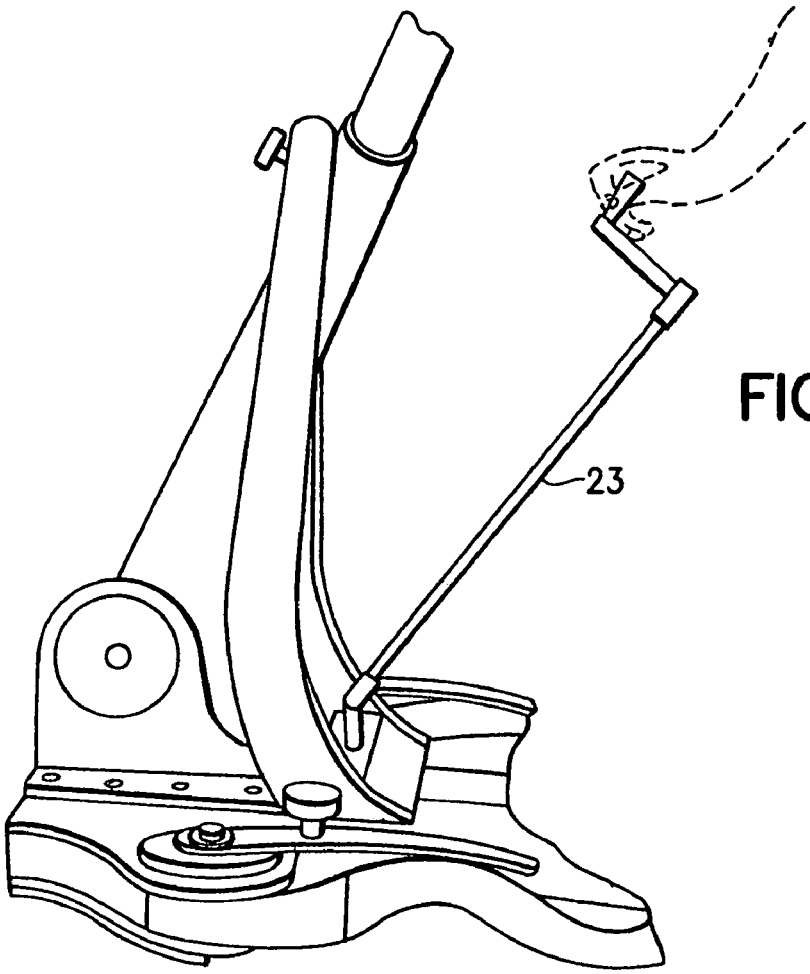
FIG.6
FIG.7
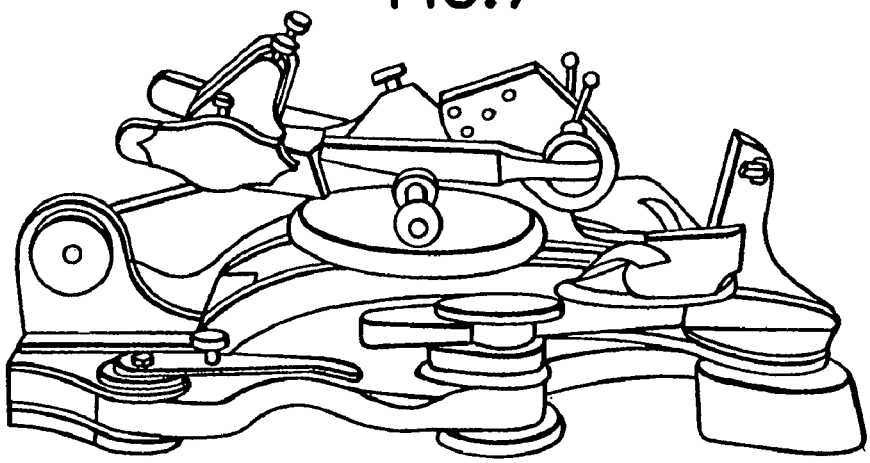

EXERCISE DEVICE

PRIORITY CLAIM

This application claims priority to U.S. Provisional Application Ser. No. 60/566,852, filed Apr. 30, 2004.

BACKGROUND OF THE INVENTION

The present invention relates to an exercise apparatus, and more particularly to an integrated exercise device including an arm system and a leg system, wherein the arm system has rotors that can be oriented in a plurality of different planes for exercising the arms. Exercise devices of many types are known, including integrated exercising devices that provide different types of exercise for different parts of the body, such as those sold under the Universal® and Nautilus® trademarks. Additionally, U.S. Pat. No. 4,850,586 teaches an exercise device that has rotors that can be oriented in any one of three mutually perpendicular planes for exercising the arms.

The drawback of these prior art systems is that it is difficult to adjust the apparatus to allow for different types of exercise.

SUMMARY OF THE INVENTION

Accordingly, it is an object of the present invention to provide an exercise apparatus that allows an easy change in the planes of rotation of the apparatus.

It is a further object to provide an apparatus which can be folded into a compact unit for easy storage.

Pursuant to these objects, and others which will become apparent hereafter, one aspect of the present invention resides in an exercise apparatus having a base with a front part and a rear, seat part that are connected together so as to be movable relative to one another to permit changing of the length of the base. Two legs are attached to opposite lateral sides of the front part of the base so as to be swingable away from and toward the base in a horizontal plane. A first mechanism is provided for adjusting the position of the legs relative to the base. A support column is pivotally mounted to the front part of the base for being selectively pivotable into an upwardly directed position and a substantially horizontal position. The support column has a sleeve member that is mounted to the front part of the base and a shaft arranged in the sleeve so as to be movable into and out of the sleeve in a telescoping manner. A second mechanism is provided for adjusting the position of the shaft in the sleeve member. A head member is mounted to the upper end of the shaft and a pair of arms is mounted on opposite sides of the head member. The arms are selectively pivotable about a horizontal axis into various positions. The arms are also selectively pivotable about an axis perpendicular to the horizontal axis into various positions so as to change an angle defined by the arms. The arms can be secured in any of the desired positions. A third mechanism is provided for adjusting and securing the position of the arms about the horizontal axis and a fourth mechanism is provided for adjusting and securing the angle between the arms. A separate exercise unit is mounted to the free end of each arm by a fifth mechanism so that the exercise units can be rotated about a longitudinal axis of the arm and secured in desired positions.

In another embodiment of the invention, the front part of the base has two rearwardly extending, parallel members and the rear part of the base has a forwardly projecting member that is slidable between the parallel members so that the length of the base can be changed.

Still another embodiment of the invention provides a securing mechanism arranged to secure the forwardly projecting member in any desired position between the rearwardly projecting members.

The rear part of the base has a seat shaft pivotally mounted thereto. The upper end of the seat shaft has a seat pivotally mounted thereto. The seat and the seat shaft are selectively pivotable between a use position in which the seat shaft extends upwardly and the seat is substantially horizontal, and a storage position in which both the seat shaft and the seat are substantially horizontal.

In yet another embodiment of the invention, the first mechanism includes a gear wheel attached to one end of a shaft that extends upwardly through the front part of the base. A toothed rack is movably arranged in a longitudinally extending slot in the bottom of the base. The rack engages with the gear so that rotation of the gear moves the rack in the slot. A separate link arm is connected between each leg and a rear end of the rack so that movement of the rack is imparted to the legs. The upper end of the gear shaft can be provided with a drive element that can be engaged by a crank for turning the gear shaft and moving the legs.

In another embodiment of the invention the second mechanism includes a threaded bushing mounted in a lower end of the shaft. A screw is threaded into the threaded bushing in a region of an upper end of the screw. The screw extends to a lower end in a bottom region of the sleeve. A first gear is mounted to the lower end of the screw. A spindle is rotatably arranged in the sleeve and has a lower end with a second gear that engages the first gear and an upper end that extends from a side of the sleeve to permit rotation of the spindle. The upper end of the spindle can have a drive element that is engageable by a crank for rotating the spindle and then turn the screw which causes the threaded bushing to move along the threads of the screw, which threaded bushing in turn moves the shaft into and out of the sleeve.

In still another embodiment, the head member has two side plates mounted on opposite sides of the shaft. The third mechanism includes a gear mounted to a horizontal shaft that extends through the side walls. The arms are mounted on opposite ends of the shaft and a worm gear is rotatably arranged in the head member so as to be in engagement with the gear and rotatable about an axis perpendicular to the horizontal axis and tangential to the gear. A handle is connected to the worm gear for turning the worm gear, and the gear in turn rotates the shaft and the arms.

In yet another embodiment a fifth mechanism includes a tube threaded at a first end and having two diametrically opposed slots extending along a midportion of the tube. A nut is threaded on the first end and a sleeve is slidably mounted over a second end of the tube. A base element closes the second end of the tube and keeps the sleeve from sliding off the tube. A pin extends transversely through both slots as to project out from the slots. The spring is arranged in the tube between the base element and the pin so as to push the pin against a bottom edge of the nut. The sleeve is mounted in the free end of the arm and the first end of the tube is attached to the exercise unit. The nut is turnable on the threaded tube so as to push the pin into contact with an upper edge of the sleeve against the force of the spring so as to secure the tube and the sleeve against relative rotation. By turning the nut in an opposite direction the spring pushes the pin away from the sleeve so as to allow the tube and the attached exercise unit to be rotated to a new position. In still another embodiment, the upper edge of the sleeve has at least two diametrically opposed notches into which the pin engages for securing against the relative rotation.

The nut, in a further embodiment, is cylindrical and has an outer cylindrical surface with a hole therein. A wrench with a semicircular-shaped head that matches the circular surface of the nut and has a projection that can engage in the hole is used for turning the nut.

All of the components of the apparatus, including the base, the legs, the support column and the arms are configured to be foldable in on one another to form an overall storage shape of the apparatus that is compact relative to a shape of the apparatus when set up for use.

Other features and advantages of the present invention will become apparent from the following description of the invention which refers to the accompanying drawings.

BRIEF DESCRIPTION OF THE DRAWINGS

FIG. 3 is a view showing the seat in a folded position;

FIG. 6 is a side view showing a crank tool inserted for moving the legs;

FIG. 7 shows the apparatus in a folded, storage position;

FIG. 10 is an enlarged view of the locking element; and

FIG. 11 is a tool for use with the locking element of FIG. 10.

DETAILED DESCRIPTION OF THE INVENTION

Figure 1:
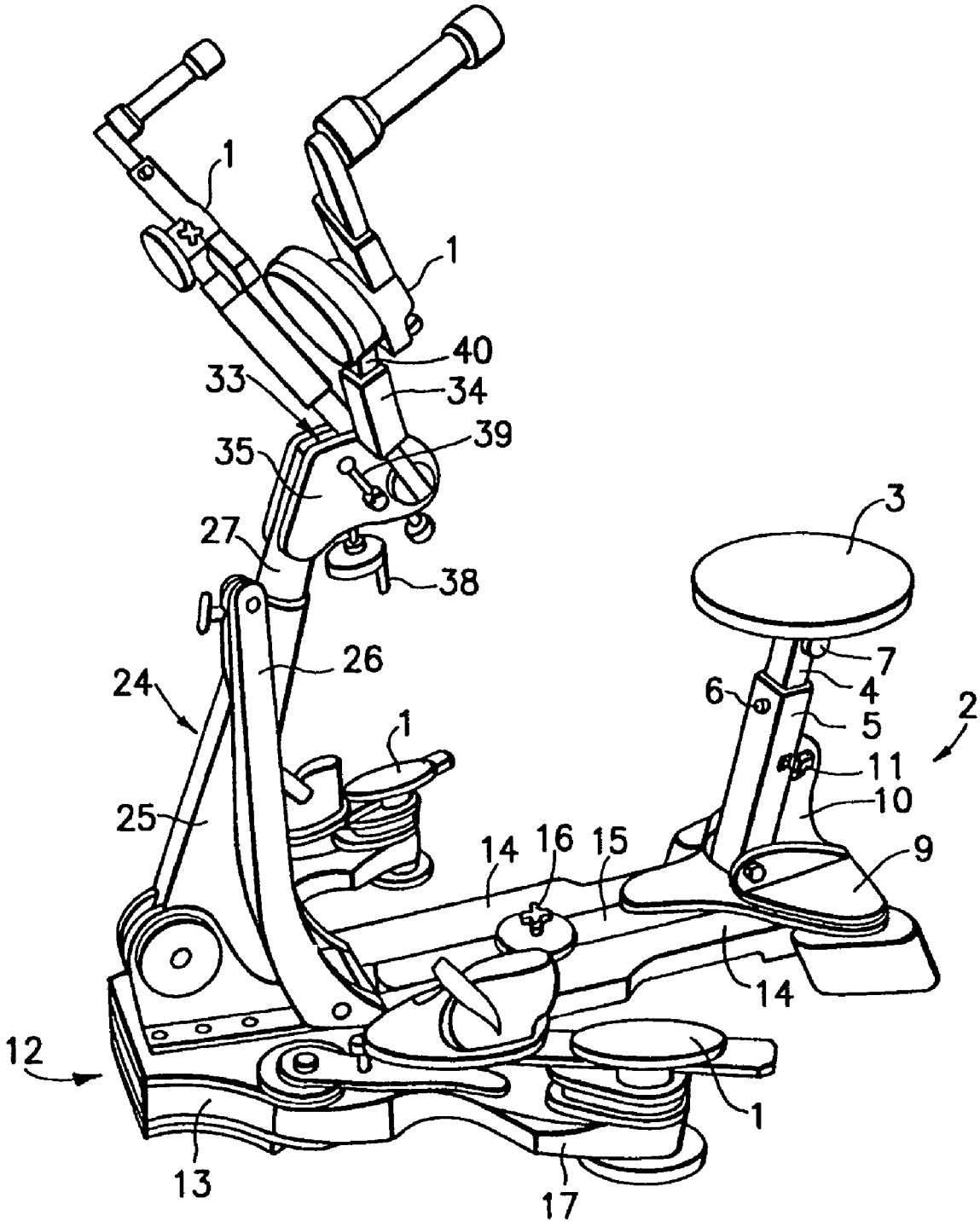
FIG. 1 is a perspective view of the inventive exercise apparatus.

FIG. 1 shows an overview of the inventive exercise apparatus. Various features of the apparatus are already known in the art and will not be discussed in detail in the present application. For example, the rotor members 1 are known and their specific construction will not be discussed in detail.

The apparatus has a frame with a seat portion 2. The seat portion 2 has a seat 3 mounted on a shaft 4 that slides within a sleeve 5 and is held in place at a selected height by a pin 6, as is conventional in the art. The seat 3 is pivotally attached to the top end of the shaft 4, as shown in FIG. 3. The seat 3 is held in a horizontal position by a pin 7 that passes through a hole in a bracket 8 that is attached to the seat and a hole in the shaft 4. The seat portion 2 also has a base 9 with a support member 10 that extends upwardly from the base 9 at an angle of less than 90° from the back of the exercise apparatus. The sleeve 5 is pivotally supported to the base 9 so that the sleeve pivots from a first position in which the sleeve rests against the support 10 to a second position in which the sleeve 5 is substantially parallel to the base as shown in FIG. 7. A latch mechanism 11 is provided for holding the sleeve 5 together with the seat in the upright position against the support 10.

Figure 2:
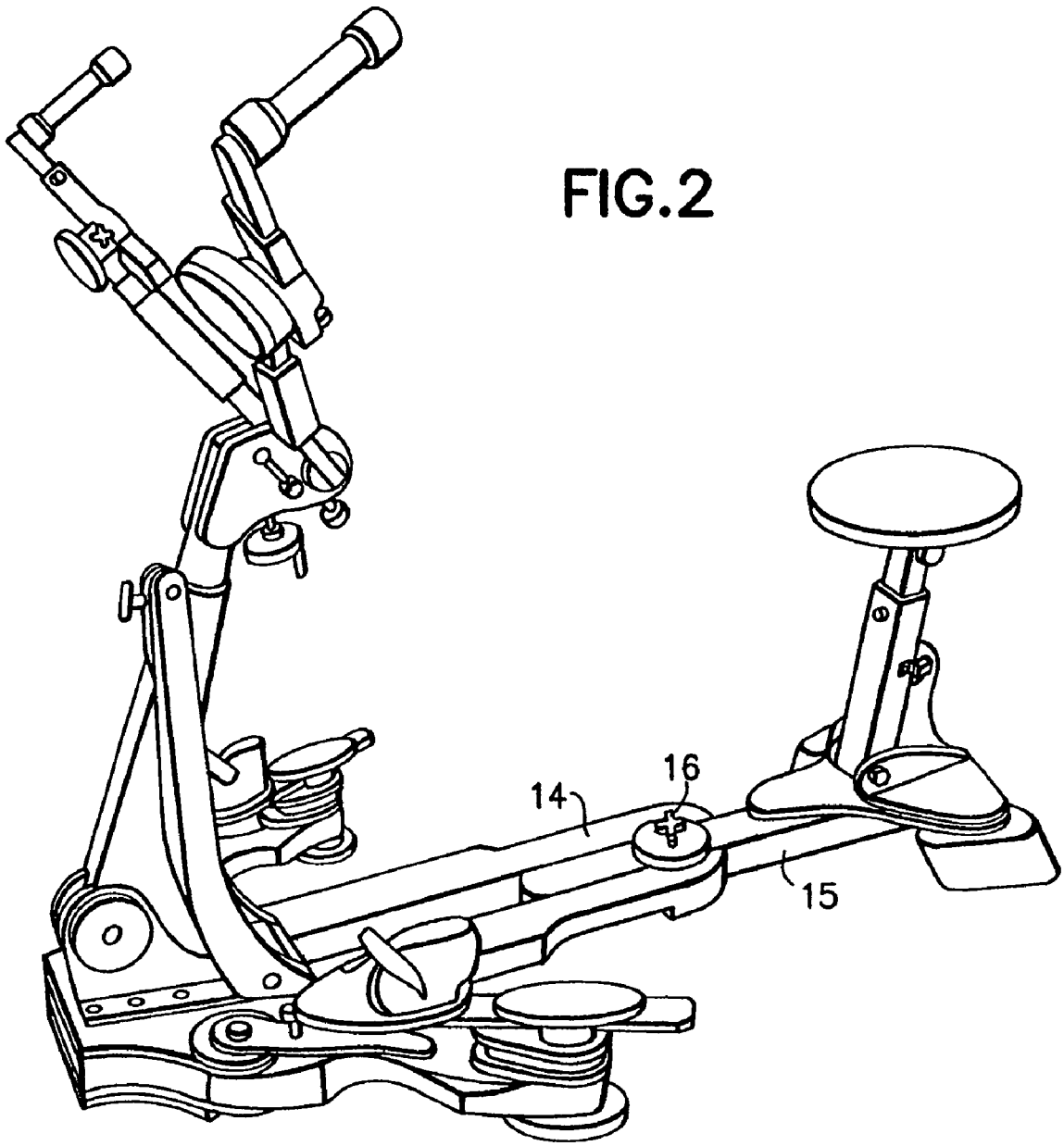
FIG. 2 is a side view of the apparatus in an extended position.
Figure 4:
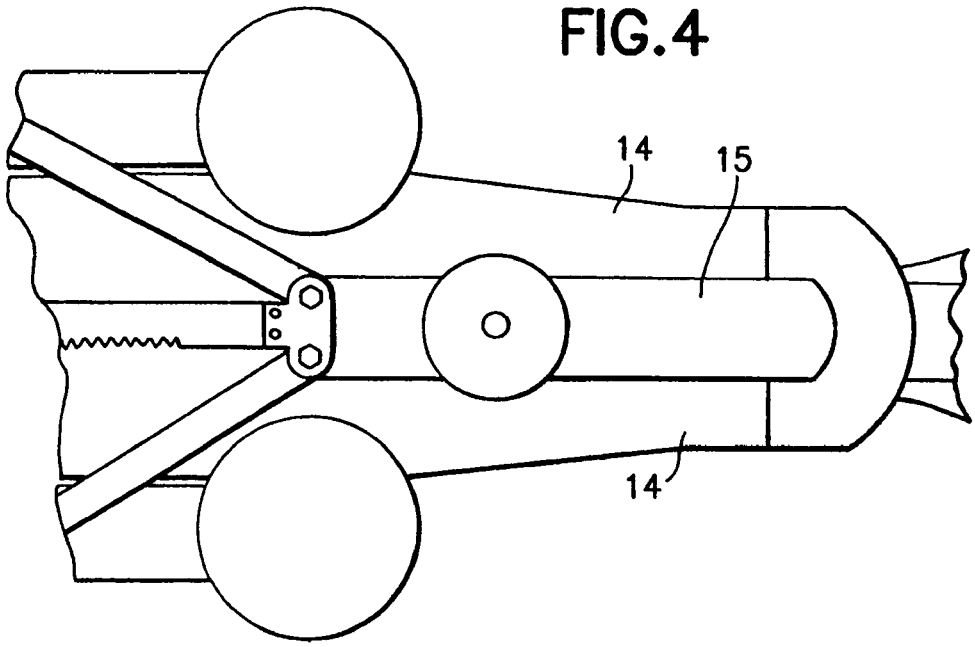
FIG. 4 is a bottom view showing the sliding elements of the front and rear portions of the base.

The exercise apparatus has a front portion 12 with a base 13 that has two parallel members 14 that extend toward the seat portion and are separated from one another to form a channel. The seat portion 2 has an elongate member 15 that fits in the channel between the members 14 in sliding fashion so that the seat portion can be moved between two end positions as shown in FIGS. 1 and 2. The seat portion can be secured in any desired position between the two end positions by a locking device 16. The locking device 16 can have any suitable construction and the illustrated embodiment merely consists of a threaded pin with a handle that passes through a large disk on the top side of the base and is threaded into a threaded disk on the bottom of the base as shown in FIG. 4. Tightening of the threaded pin causes the two disks to be forced together which secures the member 15 in the desired position between the members 14.

Two legs 17 are pivotally attached to the base 13 so as to pivot about a vertical axis. The legs 17 pivot between a first position in which the legs are directly adjacent the members 14 and an extended position as shown in FIG. 1.

Figure 5:
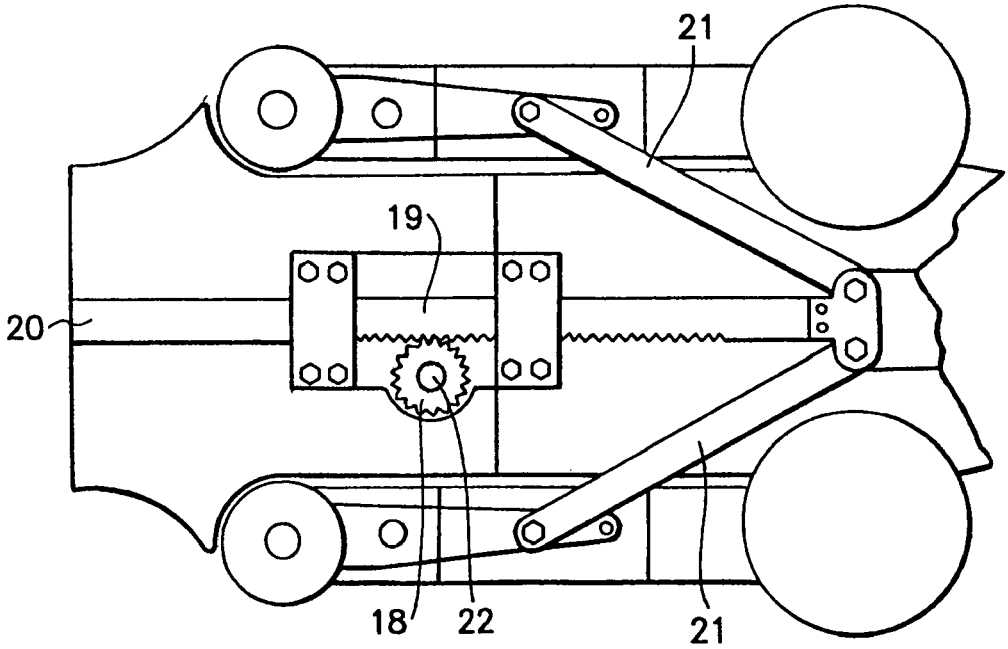
FIG. 5 is a bottom view of the base showing the operating mechanism for the legs.

The legs 17 are moved between these two positions, and can be stopped at any position in between by a rack and pinion mechanism that is shown in FIG. 5. This rack and pinion mechanism includes a pinion gear 18 arranged at the bottom of the base 13. The gear 18 engages a rack 19 that is mounted to the bottom of the base 13 so as to slide within a groove or channel 20 in the bottom of the base 13. Two arms 21 have one end rotatably attached to an end of the rack 19 facing the seat portion 2. The other end of each arm 21 is attached to a respective one of the legs 17 as shown in FIG. 5. The gear 18 is mounted on a shaft 22 that extends vertically through the base 13 and is mounted in the base 13 so as to be rotatable. The upper end of the shaft has a drive head that is engageable with a crank tool 23 as shown in FIG. 6. Rotation of the shaft 22 rotates the gear 18, which in turn moves the rack 19, which in turn moves the legs 17 via the arms 21.

The front portion also has a vertical component 24. The vertical component has a sleeve 25 that is mounted to the base 13 so that the sleeve can pivot between a use position as shown in FIG. 1 and a folded position as shown in FIG. 7. Two support arms 26 are provided on each side of the sleeve to hold the sleeve in the use position.

Figure 8:
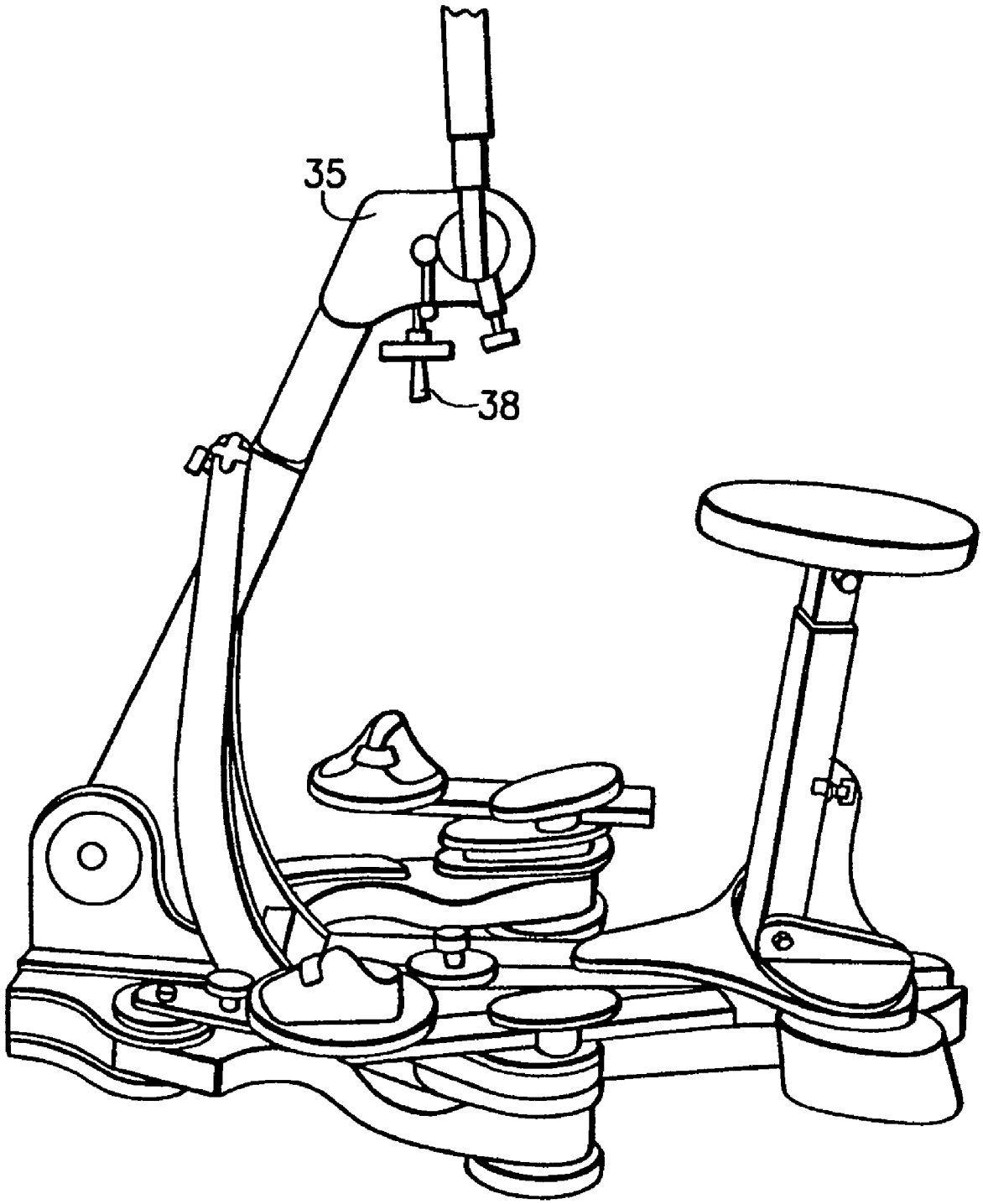
FIG. 8 shows an extended view of the front portion of the apparatus.

A shaft 27 is provided in the sleeve 25 so as to be movable between a lower most position and an extended position as shown in FIG. 8.

Figure 9:
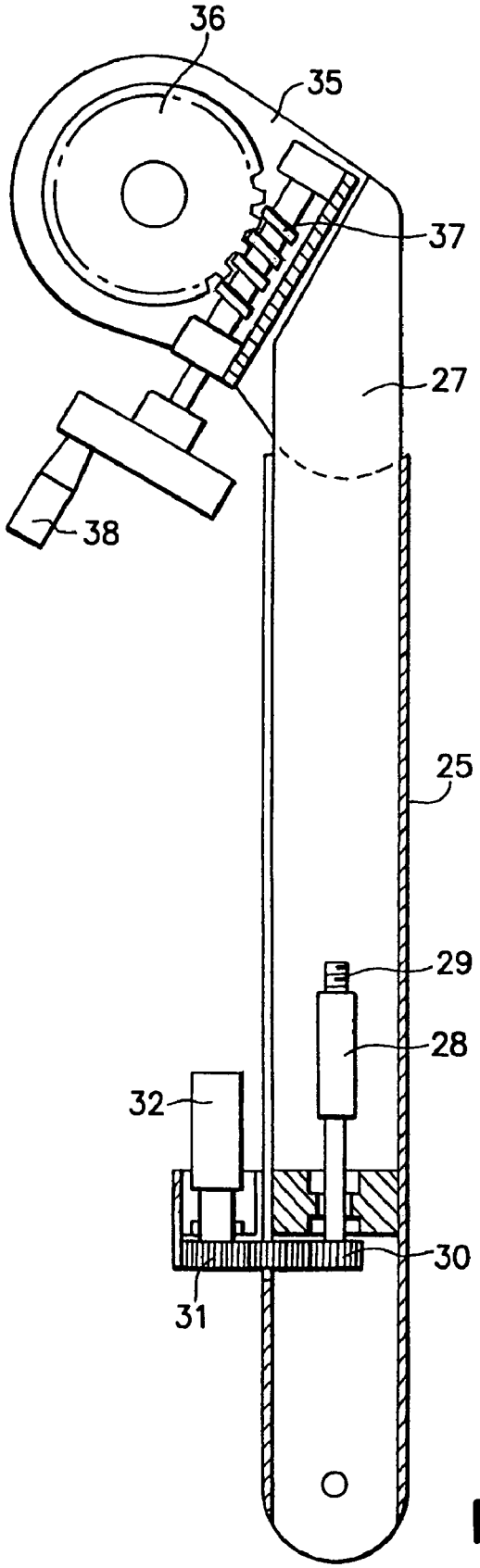
FIG. 9 is a cross-section through the front portion showing the adjustment mechanisms.

FIG. 9 shows a cross-section through the sleeve 25 and shaft 27 to illustrate how the shaft is moved within the sleeve. The lower-most end of the shaft 27 has a threaded bushing or insert 28. A threaded screw 29 is engaged in the bushing and a lower end of the screw 29 has a gear 30 that meshes with a further gear 31 that is mounted on a shaft that ends in a drive element 32 that can be driven by the crank tool 23.

A head member 33 is attached to the upper end of the shaft 27. Two arms 34 extend from the head member 33 and are rotatable into various positions about a horizontal axis and are also adjustable to change the angle between the arms 34. The head member 33 has two side plates 35 that are mounted to opposite sides of the shaft 27. Between the side plates is a gear 36 to which the arms 34 are attached. The gear 36 is turned by a worm gear 37 that is connected to a crank 38. Rotation of the crank 38 allows the arms 34 to be moved to any desired angular position.

The angle between the arms 34 can be adjusted and held in place by the locking elements 39. A construction of such locking elements is known in the art. Other types of mechanisms, such as gears, can also be used and are within the knowledge of those in the art.

At the free ends of the arms 34 are the known rotors or other exercise units 1. These rotors are connected to the arms by an adjustable locking element 40 shown in FIG. 10. The lock element includes a nut 41 that is threaded onto a threaded tube 42. The tube 42 is fixed to the rotor 1. The tube 42 has two diametrically opposed slots 43 that extend in the longitudinal direction of the tube. The other end of the tube 42 fits into a sleeve 44 that is fixed within the open upper end of the arm 34, for example, by screws. The tube 42 can move in the sleeve 44. A bottom element 45 is mounted to the open end of the sleeve 44 or the end of the tube 42. A spring 48 is arranged inside the tube and is supported at one end by the base element 45 and at the other end presses against a pin 47 that extends transversely through the tube so that the ends of the pin project from the slots 43. The top end of the sleeve 45 is provided with a plurality of pairs of diametrically opposed notches 46 which define desired positions for the rotor 1. The ends of the pin 47 engage in the desired diametrically opposed notches 46 when the nut 41 is screwed along the threaded tube so as to force the pin 47 against the spring 48 until the pin engages in the notches and is locked in place by the nut 41. In order to once again release the pin from the notches, the nut 41 is turned in an opposite direction and the spring pushes the pin out of the notches so that the tube can be rotated in the sleeve into another position. The nut has a plurality of holes 49 that can be engaged by a wrench 50 that is shaped to conform to the nut for loosening and tightening the nut 41. As shown in FIG. 7, all of the components of the apparatus are configured so as to fold in over the base members to form a compact package for storage.

Although the present invention has been described in relation to particular embodiments thereof, many other variations and modifications and other uses will become apparent to those skilled in the art. It is preferred, therefore, that the present invention be limited not by the specific disclosure herein, but only by the appended claims.

What is claimed is:

1. An exercise apparatus comprising:

a base comprising a front part and a rear connected together;

a seat part connected to the base;

two legs attached to opposite lateral sides of the front part of the base so as to be swingable away from and toward the base while remaining in a horizontal plane;

a first mechanism for adjusting a position of the legs relative to the base;

a support column pivotally mounted to the front part of the base for being selectively pivotable into an upwardly directed position or a substantially horizontal position, the support column having a sleeve mounted to the front part of the base and a shaft arranged in the sleeve so as to be movable into and out of the sleeve in a telescoping manner;

a second mechanism for adjusting a position of the shaft in the sleeve;

a head member mounted on an upper end of the shaft;

a pair of arms mounted on opposite sides of the head member so as to be selectively pivotable about a horizontal axis into various positions and selectively pivotable about an axis perpendicular to the horizontal axis into various positions so as to change an angle defined by the arms, the arms being securable in the positions;

a third mechanism for adjusting and securing the position of the arms about the horizontal axis;

a fourth mechanism for adjusting and securing the angle defined by the arms;

a pair of exercise units, each exercise unit mounted to a free end of a respective arm;

a pair of a fifth mechanisms, each mechanism of the pair of mechanisms provided on the respective arm for mounting and securing a respective exercise unit so that the respective exercise unit is operable to be rotated about a longitudinal axis of the respective arm and secured in desired positions;

wherein the first mechanism includes a shaft that extends upwardly through the front part of the base and a gear wheel attached to an end of the shaft of the first mechanism, the exercise apparatus further comprising a toothed rack movably arranged in a longitudinally extending slot in a bottom of the base, wherein the toothed rack is engaged with the gear wheel so that rotation of the gear wheel moves the toothed rack in the slot, and further comprising a pair of link arms such that each link arm is connected between each respective leg and a rear end of the toothed rack.

2. An exercise apparatus as in claim 1, wherein the front part of the base has two rearwardly extending, parallel members and the rear of the base has a forwardly projecting member slideable between the parallel members to allow a length of the base to be changed.

3. An exercise apparatus as in claim 2, further comprising a securing arrangement operatively arranged to secure the forwardly projecting member in any desired position between the rearwardly projecting members.

4. An exercise apparatus as in claim 1, the seat part further comprising a seat shaft comprising a lower end pivotally mounted to the rear of the base, an upper end, and a seat pivotally mounted on the upper end;

the seat and the seat shaft being selectively pivotable between a use position in which the seat shaft extends upwardly and the seat is substantially horizontal, and a storage position in which both the seat shaft and the seat are substantially horizontal and secured in such positions.

5. An exercise apparatus as in claim 1, wherein an upper end of the gear shaft includes a drive element, and further comprising a crank selectively engageable with the drive element for turning the gear shaft.

6. An exercise apparatus as in claim 1, wherein the base, the legs, the support column, and the arms are configured to be foldable in on one another to form an overall storage shape of the apparatus that is compact relative to a shape of the apparatus when set up for use.

7. An exercise apparatus comprising:

a base comprising a front part and a rear connected together;

a seat part connected to the base;

two legs attached to opposite lateral sides of the front part of the base so as to be swingable away from and toward the base while remaining in a horizontal plane;

a first mechanism for adjusting a position of the legs relative to the base;

a support column pivotally mounted to the front part of the base for being selectively pivotable into an upwardly directed position or a substantially horizontal position, the support column having a sleeve mounted to the front part of the base and a shaft arranged in the sleeve so as to be movable into and out of the sleeve in a telescoping manner;

a second mechanism for adjusting a position of the shaft in the sleeve;

a head member mounted on an upper end of the shaft;

a pair of arms mounted on opposite sides of the head member so as to be selectively pivotable about a horizontal axis into various positions and selectively pivotable about an axis perpendicular to the horizontal axis into various positions so as to change an angle defined by the arms, the arms being securable in the positions;

a third mechanism for adjusting and securing the position of the arms about the horizontal axis;

a fourth mechanism for adjusting and securing the angle defined by the arms;

a pair of exercise units, each exercise unit mounted to a free end of a respective arm;

a pair of a fifth mechanisms, each mechanism of the pair of mechanisms provided on the respective arm for mounting and securing a respective exercise unit so that the respective exercise unit is operable to be rotated about a longitudinal axis of the respective arm and secured in desired positions;

wherein the second mechanism includes:

a threaded bushing mounted in a lower end of the shaft;

a screw threaded into the threaded bushing in a region of an upper end of the screw and extending to a lower end in a bottom region of the sleeve;

a first gear mounted to the lower end of the screw; and a spindle rotatably arranged in the sleeve and having a lower end with a second gear that engages the first gears and an upper end that extends from a side of the sleeve to permit rotation of the spindle.

8. An exercise apparatus as in claim 7, wherein the spindle has a drive element at the upper end, and further comprising a crank selectively engageable with the drive element for rotating the spindle.

9. An exercise apparatus comprising:

a base comprising a front part and a rear connected together;

a seat part connected to the base;

two legs attached to opposite lateral sides of the front part of the base so as to be swingable away from and toward the base while remaining in a horizontal plane;

a first mechanism for adjusting a position of the legs relative to the base;

a support column pivotally mounted to the front part of the base for being selectively pivotable into an upwardly directed position or a substantially horizontal position, the support column having a sleeve mounted to the front part of the base and a shaft arranged in the sleeve so as to be movable into and out of the sleeve in a telescoping manner;

a second mechanism for adjusting a position of the shaft in the sleeve;

a head member mounted on an upper end of the shaft;

a pair of arms mounted on opposite sides of the head member so as to be selectively pivotable about a horizontal axis into various positions and selectively pivotable about an axis perpendicular to the horizontal axis into various positions so as to change an angle defined by the arms, the arms being securable in the positions;

a third mechanism for adjusting and securing the position of the arms about the horizontal axis;

a fourth mechanism for adjusting and securing the angle defined by the arms;

a pair of exercise units, each exercise unit mounted to a free end of a respective arm;

a pair of a fifth mechanisms, each mechanism of the pair of mechanisms provided on the respective arm for mounting and securing a respective exercise unit so that the respective exercise unit is operable to be rotated about a longitudinal axis of the respective arm and secured in desired positions;

wherein head comprises:

two side plates mounted on opposite sides of the shaft, the third mechanism includes a gear mounted to a horizontal shaft that extends through the side plates, the arms being mounted on opposite ends of the horizontal shaft; and a worm gear rotatably arranged in the head member so as to be in engagement with the gear and rotatable about an axis perpendicular to the horizontal axis and tangential to the gear.

10. An exercise apparatus as in claim 9, wherein the third mechanism further includes a handle connected to the worm gear for turning the worm gear and the gear.

11. An exercise apparatus comprising:

a base comprising a front part and a rear connected together;

a seat part connected to the base;

two legs attached to opposite lateral sides of the front part of the base so as to be swingable away from and toward the base while remaining in a horizontal plane;

a first mechanism for adjusting a position of the legs relative to the base;

a support column pivotally mounted to the front part of the base for being selectively pivotable into an upwardly directed position or a substantially horizontal position, the support column having a sleeve mounted to the front part of the base and a shaft arranged in the sleeve so as to be movable into and out of the sleeve in a telescoping manner;

a second mechanism for adjusting a position of the shaft in the sleeve;

a head member mounted on an upper end of the shaft;

a pair of arms mounted on opposite sides of the head member so as to be selectively pivotable about a horizontal axis into various positions and selectively pivotable about an axis perpendicular to the horizontal axis into various positions so as to change an angle defined by the arms, the arms being securable in the positions;

a third mechanism for adjusting and securing the position of the arms about the horizontal axis;

a fourth mechanism for adjusting and securing the angle defined by the arms;

a pair of exercise units, each exercise unit mounted to a free end of a respective arm;

a pair of a fifth mechanisms, each mechanism of the pair of mechanisms provided on the respective arm for mounting and securing a respective exercise unit so that the respective exercise unit is operable to be rotated about a longitudinal axis of the respective arm and secured in desired positions;

wherein each fifth mechanism includes:

a tube threaded at a first end and having two diametrically opposed slots extending along a midportion of the tube;

a nut threaded on to the first end;

a sleeve slideably mounted over a second end of the tube;

a base element closing the second end of the tube;

a pin extending transversely through both slots so as to project out from the slots; and a spring arranged in the tube between the base element and the pin so as to urge the pin toward a bottom edge of the nut;

the sleeve being mounted in the free end of the arm; and the first end of the tube being attached to the exercise unit, the nut being turnable on the threaded tube so as to push the pin into contact with an upper edge of the sleeve against force of the spring to secure the tube and the sleeve against relative rotation.

12. An exercise apparatus as in claim 11, wherein the upper edge of the sleeve has at least two diametrically opposed notches into which the pin engages for securing against the relative rotation.

13. An exercise apparatus as in claim 11, wherein the nut is cylindrical and has an outer cylindrical surface with a hole therein.

14. An exercise apparatus as in claim 13, further comprising a wrench having a semi-circular shape that matches the cylindrical surface of the nut, and a projection that engages in the hole to turn the nut.

* * * * *